US008646839B2

(12) United States Patent
Moreschi

(10) Patent No.: US 8,646,839 B2
(45) Date of Patent: Feb. 11, 2014

(54) ADJUSTMENT DEVICE FOR CHAIRS

(75) Inventor: Sergio Moreschi, Brescia (IT)

(73) Assignee: Co.Fe.Mo. Industrie S.r.l., Castegnato (IT)

( * ) Notice: Subject to any disclaimer, the term of this patent is extended or adjusted under 35 U.S.C. 154(b) by 339 days.

(21) Appl. No.: 12/993,158

(22) PCT Filed: Jun. 17, 2008

(86) PCT No.: PCT/IT2008/000399

§ 371 (c)(1),
(2), (4) Date: Feb. 8, 2011

(87) PCT Pub. No.: WO2009/153811

PCT Pub. Date: Dec. 23, 2009

(65) Prior Publication Data

US 2011/0127820 A1 Jun. 2, 2011

(51) Int. Cl.
*A47C 1/024* (2006.01)

(52) U.S. Cl.
USPC ..... 297/300.5; 297/300.2

(58) Field of Classification Search
USPC ..... 297/285, 291, 292, 293, 296, 299, 297/300.5, 300.4, 300.2
See application file for complete search history.

(56) References Cited

U.S. PATENT DOCUMENTS 4,411,469 A * 10/1983 Drabert et al. ..... 297/300.2
4,471,994 A * 9/1984 Zund et al. ..... 297/300.3
4,854,641 A 8/1989 Reineman et al.
4,966,411 A 10/1990 Katagiri et al.
6,234,573 B1 * 5/2001 Roder et al. ..... 297/300.5
6,431,649 B1 * 8/2002 Hensel ..... 297/300.2
6,523,896 B1 * 2/2003 Uhlenbrock ..... 297/300.4
6,709,057 B2 * 3/2004 Sander et al. ..... 297/316
7,422,287 B2 * 9/2008 Heidmann et al. ..... 297/354.1
8,272,692 B1 * 9/2012 Epperson ..... 297/300.3
2002/0167209 A1 * 11/2002 Sander et al. ..... 297/316
2010/0084904 A1 4/2010 Erker
2010/0244522 A1 * 9/2010 Fukai ..... 297/300.3

FOREIGN PATENT DOCUMENTS

DE 10 2006 056928 B3 6/2008
EP 0339089 A 11/1989
FR 2461472 A 2/1981

* cited by examiner

*Primary Examiner* — David Dunn
*Assistant Examiner* — Alexander Harrison
(74) *Attorney, Agent, or Firm* — Pearne & Gordon LLP

(57) ABSTRACT

An adjustment device for chairs, comprising a main body (2), which can be engaged onto a supporting shank (3) of a chair; a prop element (6) mounted above the main body (2), which can be associated to a seat for a user; a backrest (10) mounted onto the main body (2), which can be associated to a back (11) for a user; and articulation means (14) for movably engaging the backrest (10) and the prop element (6) to the main body (2), the articulation means (14) comprise at least one lever (17) pivoting around the main body (2) in a first mounting site and having at least two lever portions (17*a*, 17*b*) hinged to the prop element (6) in a second mounting site and to the backrest (10) in a third mounting site, respectively, so as to obtain a given movement relation between the backrest (10) and the prop element (6).

26 Claims, 2 Drawing Sheets

ADJUSTMENT DEVICE FOR CHAIRS

Figure 1A:
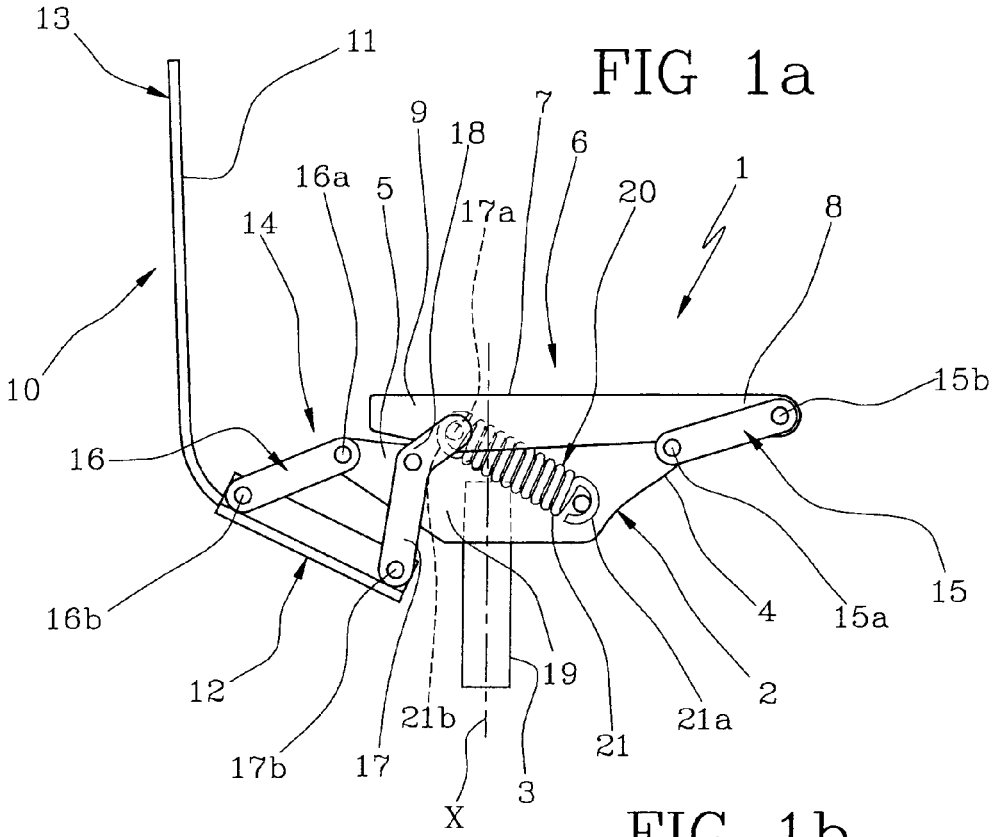

The present invention relates to an adjustment device for chairs, i.e. a mechanism onto which the seat and back of a chair, preferably an office chair, are mounted and which can give said seat and back a predefined reciprocating movement.

As is known, adjustment devices consist of a main body, basically box-shaped and engaged on the top of a chair supporting shank.

The box-shaped body defines a support member for back and seat hinging means, which enable the movement of said back and seat.

When the user sits down with his/her weight on the seat and leans onto the back, the back reclines, i.e. inclines downwards and towards the rear of the chair, and depending on the type of mechanism also the seat can or cannot be adjusted in a second operating position.

In particular, the present invention relates to mechanisms for chairs in which a movement of the seat of the chair is related to the movement of the back.

In a first conventional type of these mechanisms, the resistance to reclining of the back of the chair is given only by an elastic contrast element, which can be suitably preloaded so as to suit different users.

In a further type of mechanisms, known as "weighing" mechanisms in the field, the resistance to reclining of the back of the chair is related to a user's weight resting on the seat, as well as to a smaller extent to a contrast spring whose function is both to prevent the seat from reclining when the chair is not used, and if necessary to suitably integrate and correct the resistance to reclining due only to weight.

Known mechanisms have some drawbacks, related for instance to the type of movement of the seat with respect to the back, which is often not ergonomically optimal for the user.

Other drawbacks of known mechanisms are due for instance to the often bulky size of known mechanisms, which limit chair design freedom, to the complexity of known mechanisms, to high costs and to their reliability, which is not always high.

A further drawback of conventional mechanisms is due to the need for an elastic contrast element, suitably sized so as to provide a contrast to back reclining that suits both very light and heavier users.

This involves design difficulties, the need for a manual adjustment of the preload of the elastic element so as to adapt it to each user, and a resistance to reclining that is often not completely suitable for very light or very heavy users.

These latter drawbacks are dealt with by the above mentioned "weighing mechanisms", which can consist for instance of a hinged quadrilateral connecting seat and main body as well as seat and main body. The hinged quadrilateral enables a synchronous movement of back and seat, the rear portion of the seat rotating upwards while the back rotates and travels downwards.

Also this solution, however, has some drawbacks, mainly due to the type of relative movement of back and seat.

Indeed it can be seen that, while the back drops bringing the user's back downwards, the user's hips are lifted and moved forward. This combined movement, though occurring synchronously, is perceived as annoying by the user, who feels in his/her lumbar region a stretching effect due to seat and back moving apart one from the other (said effect being known in the field as "sheet-pulling effect" since the user has his/her clothes annoyingly pulled). In other cases, the poor ergonomic character of the oscillating movement of the chair is due to a forward movement or inclination of the seat while the back is rotated backwards, and thus to a mismatched rotation of seat and back.

Under these circumstances, the technical task underlying the present invention is to propose an adjustment device for chairs that is able to obviate the above mentioned drawbacks.

The main aim of the present invention is to provide an adjustment device which has an effective tilting movement and which is easy to carry out, compact and low-cost.

A further aim of the invention is to provide an adjustment device which is reliable and which is able at the same time to provide for an agreeable movement of back and seat matching the user's anatomy.

A particular aim of the invention is to provide an adjustment device of "weighing" type, which offers an optimal resistance to back inclination for any user and which has an ergonomically appropriate movement of back and seat.

Figure 1B:
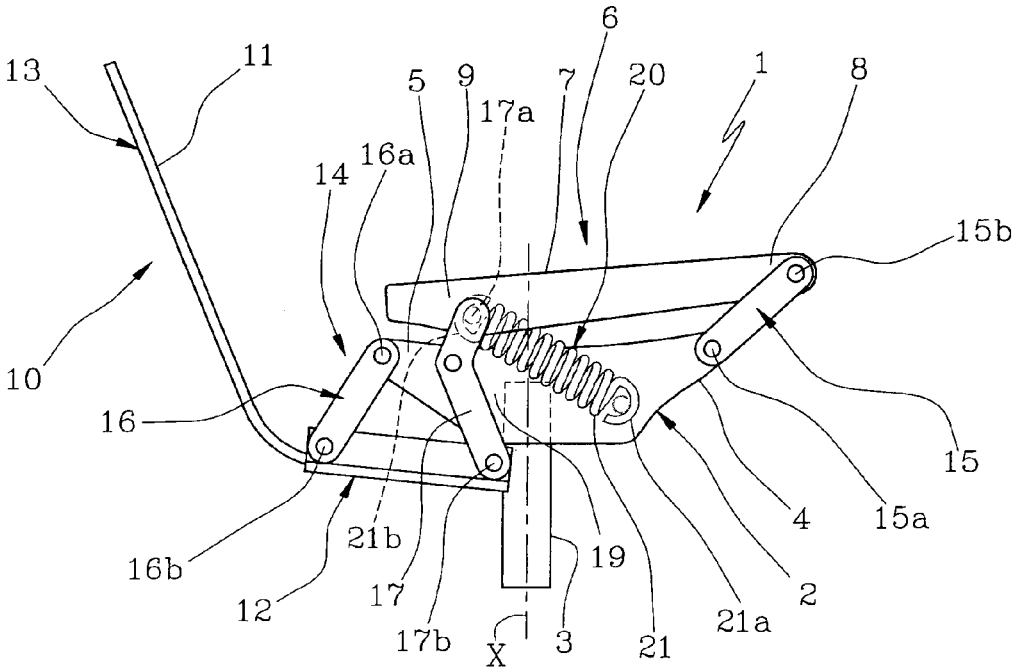
Figure 2A:
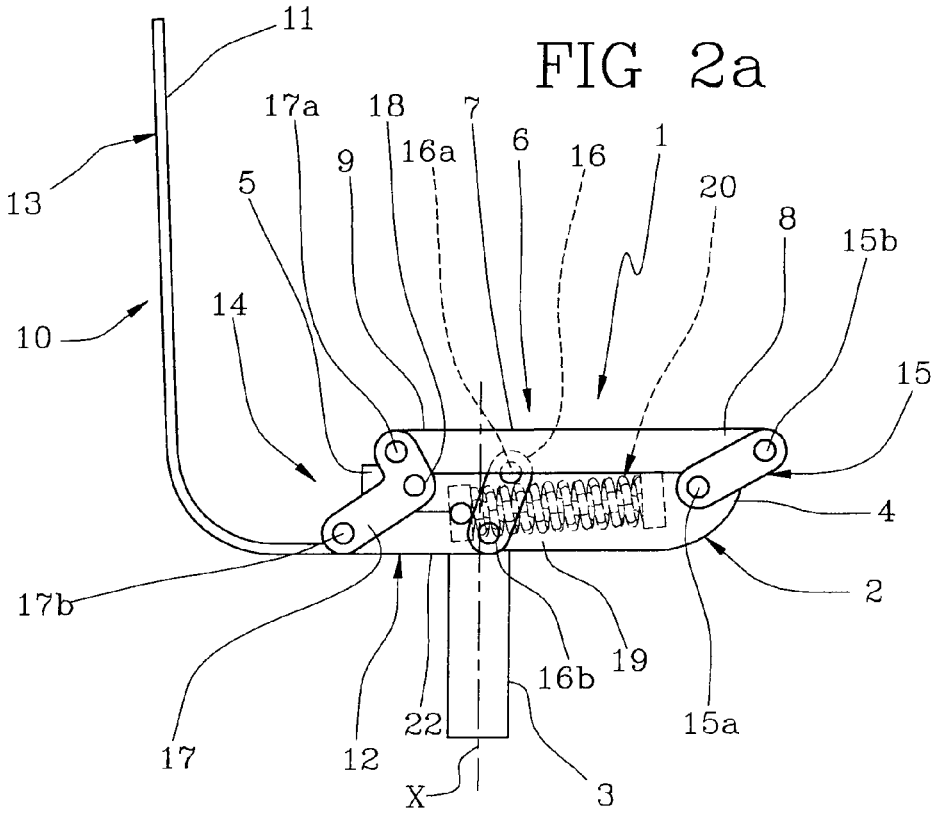
Figure 2B:
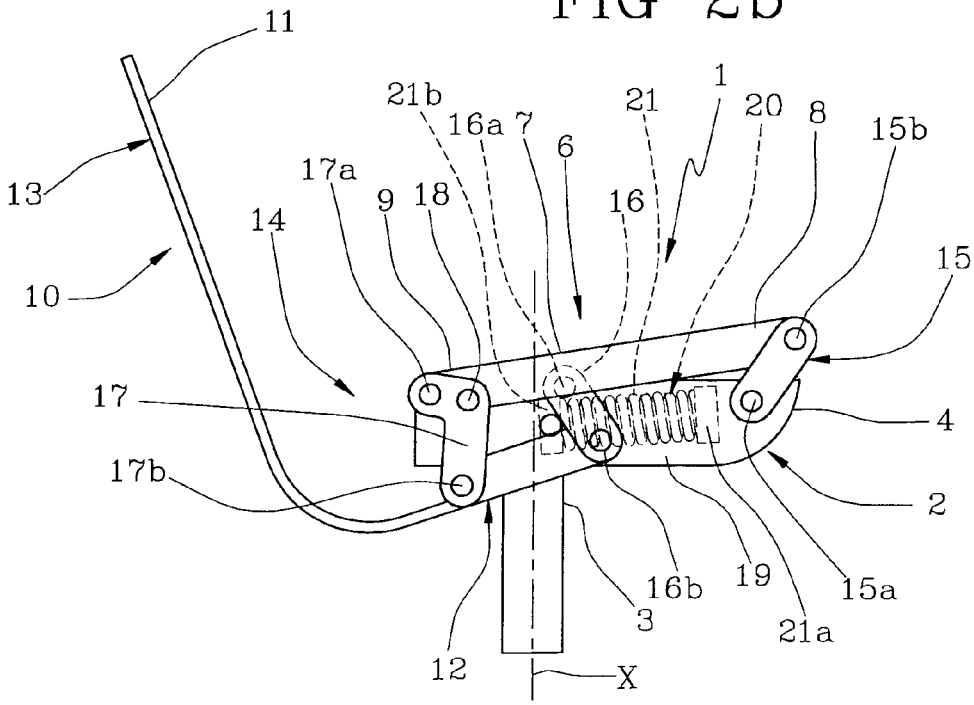

These and other aims, which shall be better understood from the following description, are achieved according to the present invention by an adjustment device for chairs in accordance with claim 1 and/or one or more dependent claims. Further characteristics and advantages of the invention shall be more evident from the description of a preferred, though not exclusive embodiment of an adjustment device for chairs, in accordance with the following detailed disclosure made thanks to the following figures:

FIGS. 1*a* and 1*b* show schematic side views of the adjustment device according to a first embodiment of the present invention, in a rest position and in an operating position, respectively; and FIGS. 2*a* and 2*b* show schematic side views of a second embodiment solution of the adjustment device, in a rest position and in a reclined operating position, respectively.

With reference to the accompanying figures, the numeral 1 globally refers to an adjustment device or mechanism for chairs, in particular office chairs, the latter not being shown in detail since they are of known type and do not fall within the framework of the present invention.

The device 1 comprises a main body 2, engaged on the top of a chair supporting shank 3, as schematically shown in the accompanying figures in partial view only.

The main body 2 can be basically box-shaped or have any other suitable structural shape and consists of a front portion 4 defined in a prop area for the user's legs, and of a rear portion 5 defined in a prop area for the user's sacral region.

A prop element 6 develops above the main body 2, said element being preferably flat-shaped and being equipped with a prop surface 7 to which a seat of known type for a user can be associated, said seat being arranged facing away from the body 2. The prop surface 7 defines a basically horizontal plane through which the user's weight rests on the prop element 6.

In an alternative embodiment, the prop element 6 can be integrated into the seat and therefore the latter can be mounted directly onto the main body.

The prop element 6 further consists of a front portion 8 arranged on the front portion 4 of the body 2, and a rear portion 9 arranged on the rear portion 5 of the body 2.

The device 1 further has a backrest 10 mounted onto the main body 2, which rest can be associated on a prop surface 11 to a back of known type and not further described or disclosed, which props a user's back and extends at least partially above the rear portion of the seat.

In an alternative embodiment, the backrest 10 can be integrated into the back and therefore the latter can be mounted directly onto the main body.

In particular, in the disclosed embodiments the backrest 10 is basically L-shaped in longitudinal section and defines a lower portion 12 facing the main body 2, and an upper portion 13 close to the lower one 12 and having said prop surface 11.

The device 1 further has articulation means 14 for movably engaging the backrest 10 and the prop element 6 to the main body 2. The articulation means 14 cause a coordinated movement of the backrest 10 and of the prop element 6 with respect to the body 2.

In the embodiments shown in FIGS. 1 and 2, the articulation means 14 are configured so as to transfer part of the user's weight acting upon the prop element 6 as a force opposing the inclination of the backrest, thus causing a resistance to the inclination of the backrest 10, from a rest position to a reclined position with respect to the main body 2, as a function of the user's weight acting upon the prop element 6.

Conversely, in a conventional device the resistance to reclining of the chair back is caused only by an elastic contrast element which can be appropriately preloaded so as to suit various users.

According to the present invention, the articulation means 14 comprise at least one lever 17 pivoting around the main body 2 in a first mounting site and having at least two opposite ends or lever portions 17*a*, 17*b* hinged to the prop element 6 in a second mounting site and to the backrest 10 in a third mounting site, respectively, so as to create a given movement relation between the backrest 10 and the prop element 6.

The wording "opposite ends" or "lever portions" 17*a*, 17*b* refers to two opposed ends with respect to the first mounting site, i.e. developing along different directions from said mounting site.

According to the present invention, the lever 17 refers to a connection element which is apt to transfer the above disclosed movement and can have any suitable shape.

In the present disclosure, the term "end" means a portion of any suitable shape, which can be hinged in any suitable site and not only on the end portion of said end.

Moreover, the opposite ends or lever portions 17*a*, 17*b* are hinged to the prop element 6 and to the backrest 10 in the second and third mounting sites, respectively, which sites can be arranged anywhere on the ends 17*a*, 17*b* or lever portions.

The connection element is preferably made as one piece.

Moreover, two levers can be present, arranged on each side of the chair, preferably symmetrically.

The first, second and third mounting sites can be advantageously disaligned one with the other, so that the line joining the first and the second mounting site is transversal to the line joining the first and the third mounting site.

Moreover, the distance between the first and the second mounting site can be preferably different from the distance between the first and the third mounting site.

Each one of the two technical features referred to above, alone or in combination, enables to easily design and size the lever in an appropriate way so as to obtain the desired movement relation and load transfer.

Preferably, the lever consists of two basically rectilinear lever portions 17*a*, 17*b*.

Preferably, the third mounting site is located at a lower height than the first and the second mounting sites.

Preferably, the second mounting site is located at a higher height than the first and the second mounting sites.

The terms "lower" or "higher height" mean the vertical position of the mounting sites in a condition of normal use of the chair, i.e. along the vertical direction corresponding to the longitudinal development of the supporting shank 3.

More particularly, the lever 17 can be basically bow-shaped or anyhow be angled, and defines an angular portion 18 placed between the lever portions or ends 17*a*, 17*b* of said lever 17, and turnably engaged to the main body 2 in the first mounting site.

Advantageously, in the first embodiment, in order to obtain a "weighing" mechanism, the pivoting lever 17 is configured so as to convert a movement for reclining the backrest into an at least partially ascending movement of the second mounting site.

Moreover, the articulation means 14 and the pivoting lever 17 are preferably configured so as to convert a rotational and traveling movement of reclining of the backrest 10 into a rotational and traveling movement upward and of inclination of the prop element 6, obtaining here again a "weighing" mechanism.

The articulation means 14 further preferably comprise a first and second swinging arm 15, 16, both hinged to the main body 2 and hinged to the prop element 6 and to the backrest 10, respectively. The first swinging arm 15 has a first end 15*a* hinged to the front portion 4 of the main body 2, and a second end facing away from the first one 15*a* and hinged to the front portion 8 of the prop element 6. The second swinging arm 16 has a first end 16*a* hinged to the main body and a second end 16*b* facing away from the first one 16*a* and hinged to the lower portion 12 of the backrest 10.

The first swinging arm 15 defines a first hinged quadrilateral together with the lever 17, the prop element 6 and the main body 2, whereas the second swinging arm 16 defines a second hinged quadrilateral together with the lever 17, the backrest 10 and the main body 2. The overall mechanism consisting of the swinging arms 15, 16 and of the lever 17 is a hexalateral.

According to the first embodiment solution shown in FIGS. 1*a* and 1*b*, the first and second swinging arms 15, 16 are housed on opposite parts with respect to the pivoting lever 17, i.e. the pivoting lever 17 is placed between the first and the second swinging arm 15, 16.

As far as also swinging arms are concerned, in the present text end means a portion of any suitable shape, which can be hinged in any suitable site and not only on the end portion of said end.

Under these circumstances, the first end 16*a* of the second swinging arm 16 is hinged to the rear portion 5 of the main body 2, whereas the second end 16*b* is hinged to the lower portion 12 approaching said upper portion 13 of the backrest 10.

It should be further noted that, under these circumstances, the lever 17 pivots on a middle portion 19 of the main body 2 and has a first end 17*a* hinged close to the rear portion 9 of the prop element 6, and a second end 17*b* hinged to an end of the lower portion 12 distal with respect to the upper portion 13 of the backrest 10. In the disclosed embodiments, the articulation means 14 further comprise an elastic return element 20, associated to the main body 2 so as to push the backrest 10 from its reclined position to its rest position, which is basically vertical.

Advantageously, the elastic return element 10 can comprise a helical spring 21. In the case of a weighing mechanism, the elastic return element 20 can be smaller and acts in operating condition at least so as to keep the backrest 10 in its rest position when the user's weight does not rest on the prop element 6, and only partially contributes to the resistance offered by the back in addition to the resistance effect represented by the mechanism itself.

In conventional mechanisms not of "weighing" type, conversely, the elastic return element 20 should be of larger size since it has to cause alone the resistance to reclining of the back, and it is equipped with known preloading means to adjust the preload thereof and thus the resistance to reclining of the back.

For instance, in the first embodiment the elastic return element 20 is associated to the main body 2 on an end of the pivoting lever 17. A first end 21*a* of the helical spring 21 is therefore linked to the main body 2 and a second end 21*b* is linked to the first end 17*a* of the lever 17. The elastic return element 20 can be associated to the pivoting lever in any suitable site and/or to other movable elements of the chair, such as the prop element 6 and the backrest 10.

For instance, according to the second embodiment solution of FIGS. 2*a* and 2*b* the second swinging arm 16 is placed between the first swinging arm 15 and the pivoting lever 17. Under these circumstances, the pivoting lever 17 is close to the backrest 10. Note indeed that the first end 17*a* of the pivoting lever 17 is hinged to the rear portion 9 of the prop element 6, whereas the second end 17*b* is hinged to the lower portion 12 in a position close to the upper portion 13 of the backrest 10. Under these circumstances, the first end 16*a* of the second swinging arm 16 is hinged to the middle portion 19 of the main body 2, whereas the second end 16*b* is hinged to an end of the lower portion 12 distal with respect to the upper portion 13 of the backrest 10. In this case, the helical spring 21 is advantageously provided with a first end 21*a* engaged to the main body 2 on the corresponding middle portion 19, and with a second end 21*b* having a pin 22 cooperating with the second swinging arm 16.

In both embodiment solutions described above, the hinging means 14 therefore define a hexalateral and enable an effective and optimal movement of the prop element 6 and of the backrest 10 between a rest position (FIGS. 1*a* and 2*a*) and reclined position (FIGS. 1*b*, 2*b*).

In further detail, in rest position the sitting surface 7 is basically perpendicular to a vertical axis "X" of development of the shank 3 and the prop surface 11 is basically parallel to axis "X". In order to reach the reclined position, the prop element 6 and the backrest 10 rotate and travel so as to arrange the prop surfaces 7 and 11 both reclined and transversal to vertical axis "X".

Note that the prop element 6 in operating position rotates with respect to the first end 17*a* of the lever 17 and with respect to the first end 15*a* of the first swinging arm 15. Advantageously, the prop element 6 rotates and travels getting closer to the rear portion 5 of the body 2 and inclining with the corresponding front portion 8 away from the main body 2. Under these circumstances, the sitting surface 7 is descending towards the backrest 10.

Simultaneously to the movement of the prop element 6, also the backrest 10 in operating position rotates with respect to the second end 17*b* of the lever 17 and with respect to the second end 16*b* of the second swinging arm 16. Advantageously, the backrest 10 rotates and travels getting closer to the corresponding lower portion 12 under the body 2 and inclining with the corresponding upper portion away from the prop element. Under these circumstances, the prop surface 11 is descending towards the supporting shank 3. It should further be pointed out that in the first embodiment the resistance of the back to reclining is proportional to the user's weight acting synchronously upon the sitting surface 7 and upon the prop surface 11.

When the user stands up from the chair, the helical spring 21 acts upon the backrest 10 and the prop element 6 bringing them back to their rest position.

In particular, with reference to the first embodiment solution, note that the spring 21 is slightly preloaded in traction so as to keep the prop element 6 and the backrest 10 in their rest position (FIG. 1*a*). In operating position the helical spring 21 is further pulled (FIG. 1*b*) so as to bring the backrest 10 in vertical position when the user stands up from the chair. It should be noted that the second end 21*b* of the spring 21 acts as a traction upon the first end 17*a* of the lever 17. As a result, pulling the first end 17*a* of the lever 17 towards the first end 21*a* of the spring 21 causes the movement of the prop element 6 and the backrest 10, both associated to said lever 17.

With reference to the second embodiment solution, note that the spring 21 is slightly preloaded in compression so as to keep the prop element 6 and the backrest 10 in their rest position (FIG. 2*a*). In operating position the helical spring 21 is further compressed (FIG. 2*b*) and offers its whole resistance to reclining of the back, so as to bring the backrest 10 in vertical position when the user stands up from the chair. It should be noted that the pin 22 protruding from the second end 21*b* of the spring 21 acts as a thrust upon the second swinging arm. As a result, moving the second swinging arm 16 away from the first end 21*a* of the spring 21 causes the movement of the prop element 6 and the backrest 10.

It should further be pointed out that the articulation means 14 equipped with the lever 17 according to the invention can include as an alternative also other mechanisms than said swinging arms, such as for instance hinges associated to slots, or other known joints suitable for mechanisms and to the aims set forth.

In particular, the first and/or the second swinging arm could be replaced by a hinged and slotted joint, of per se known type and therefore not disclosed in further detail. As an alternative, the first and/or the second swinging arm could be associated to a hinged and slotted joint.

The present invention achieves the aims set forth and overcomes the drawbacks of prior art. As a matter of fact, the articulation means described allow a fluid and effective tilting movement, both in the case of weighing and of conventional mechanisms. Moreover, the invention can be adapted to designers' various needs since it enables to obtain a large number of mechanisms with different movements in a simple manner and with few structural changes. A further important advantage of the present invention is the movement of the backrest and of the prop element, which is particularly ergonomic for the user.

Moreover, the invention is easy and inexpensive to carry out.

The invention claimed is:

1. An adjustment device for chairs, comprising:

a main body structured to be engaged onto a supporting shank of a chair;

a seat support mounted above said main body and structured to be associated to a seat for a user;

a backrest mounted onto said main body and structured to be associated to a back for a user; and articulation means for movably engaging the backrest and the seat support to the main body, wherein said articulation means comprise a lever hinged to said main body in a first mounting site and having two opposite lever portions hinged to the seat support in a second mounting site and to the backrest in a third mounting site, respectively, so as to obtain a relative movement between said backrest and said seat support wherein said articulation means further comprises a first swinging arm hinged to the main body and to the seat support and a second swinging arm hinged to the main body and to the backrest, said first swinging arm defining together with said lever, said seat support and said main body a first hinged quadrilateral and said second swinging arm defining together with said lever, said backrest and said main body a second hinged quadrilateral, and wherein said lever defines an angular portion turnably engaged to said main body in said first mounting site; said angular portion being placed between said lever portions of the lever.

2. The device according to claim 1, wherein the lever and said articulation means are configured so as to transfer part of the user's weight acting upon the seat support as a force opposing the inclination of the backrest, thus causing a resistance to the inclination of the backrest, from a rest position to a reclined position with respect to the main body, depending upon the user's weight acting upon the seat support.

3. The device according to claim 1, wherein said first swinging arm has a first end hinged to a front portion of the main body distal with respect to said backrest, and a second end facing away from the first one and hinged to a front portion of the seat support also distal with respect to the backrest; and in that said second swinging arm has a first end hinged to the main body, and a second end facing away from the first one and hinged to a lower portion of said backrest.

4. The device according to claim 1, wherein said first, second and third mounting sites are disaligned one with the other, so that the line joining the first and the second mounting site is transversal to the line joining the first and the third mounting site.

5. The device according to claim 4, wherein the distance between said first and said second mounting site is different from the distance between said first and said third mounting site.

6. The device according to claim 1, wherein said lever is bow-shaped.

7. The device according to claim 1, wherein said lever is configured so as to convert a reclining movement of said backrest into an at least partially ascending movement of said second mounting site.

8. The device according to claim 1, wherein said articulation means and said lever are configured so as to convert a rotational and traveling movement of reclining of said backrest into a rotational and traveling upward movement of said seat support.

9. The device according to claim 1, wherein said lever is placed between said first and said second swinging arm.

10. The device according to claim 9, wherein said second swinging arm has its first end hinged to a rear portion of the main body close to said backrest, and its second end hinged to an end of the lower portion of the backrest.

11. The device according to claim 1, wherein said second swinging arm is placed between said first swinging arm and said lever.

12. The device according to claim 11, wherein said lever has a first lever portion hinged to a rear portion of seat support facing away from the front portion and close to the backrest, and a second lever portion hinged to an end of the lower portion of the backrest.

13. The device according to claim 12, wherein said second swinging arm has its first end hinged to a middle portion of the main body, and its second end hinged to an end of the lower portion of the backrest.

14. The device according to claim 1, wherein said articulation means further comprise an elastic return element associated to the main body so as to push the backrest towards its rest position, said elastic return element acting at least to keep said backrest in said corresponding rest position when the user's weight does not rest on the seat support.

15. The device according to claim 1, wherein said articulation means allow the movement of the seat support and of the backrest between a rest position in which a sitting surface of the seat support is basically perpendicular to a vertical axis of development of the shank and the prop surface of the backrest is basically parallel to said vertical axis, and a reclined position in which the seat support and the backrest rotate and travel so as to place both the sitting surface and the prop surface transversal to said vertical axis.

16. The device according to claim 1, wherein said articulation means comprise a hexalateral mechanism formed by said first and second hinged quadrilaterals.

17. The device according to claim 1, wherein said lever consists of said two lever portions, said two lever portions being substantially rectilinear.

18. The device according to claim 1, wherein said third mounting site is arranged at a lower height than said first and said second mounting site.

19. The device according to claim 1, wherein said second mounting site is arranged at a higher height than said first and said third mounting site.

20. An adjustment device for chairs, comprising:

a main body structured to be engaged onto a supporting shank of a chair;

a seat support mounted above said main body and structured to be associated to a seat for a user;

a backrest mounted onto said main body and structured to be associated to a back for a user; and articulation means for movably engaging the backrest and the seat support to the main body, wherein said articulation means comprise a lever hinged to said main body in a first mounting site and having two opposite lever portions hinged to the seat support in a second mounting site and to the backrest in a third mounting site, respectively, so as to obtain a relative movement between said backrest and said seat support, wherein said articulation means further comprises a first swinging arm hinged to the main body and to the seat support and a second swinging arm hinged to the main body and to the backrest, said first swinging arm defining together with said lever, said seat support and said main body a first hinged quadrilateral and said second swinging arm defining together with said lever, said backrest and said main body a second hinged quadrilateral, and wherein said lever is configured so as to convert a reclining movement of said backrest into an at least partially ascending movement of said second mounting site.

21. The device according to claim 20, wherein said articulation means and said lever are configured so as to convert a rotational and traveling movement of reclining of said backrest into a rotational and traveling upward movement of said seat support.

22. The device according to claim 20, wherein said lever is placed between said first and said second swinging arm and wherein said second swinging arm has its first end hinged to a rear portion of the main body close to said backrest, and its second end hinged to an end of the lower portion of the backrest.

23. An adjustment device for chairs, comprising:

a main body structured to be engaged onto a supporting shank of a chair;

a seat support mounted above said main body and structured to be associated to a seat for a user;

a backrest mounted onto said main body and structured to be associated to a back for a user; and articulation means for movably engaging the backrest and the seat support to the main body, wherein said articulation means comprise a lever hinged to said main body in a first mounting site and having two opposite lever portions hinged to the seat support in a second mounting site and to the backrest in a third mounting site, respectively, so as to obtain a relative movement between said backrest and said seat support, wherein said articulation means further comprises a first swinging arm hinged to the main body and to the seat support and a second swinging arm hinged to the main body and to the backrest, said first swinging arm defining together with said lever, said seat support and said main body a first hinged quadrilateral and said second swinging arm defining together with said lever, said backrest and said main body a second hinged quadrilateral, and wherein said third mounting site is arranged at a lower height than said first and said second mounting site.

24. The device according to claim 23, wherein said first swinging arm has a first end hinged to a front portion of the main body distal with respect to said backrest, and a second end facing away from the first one and hinged to a front portion of the seat support also distal with respect to the backrest; and in that said second swinging arm has a first end hinged to the main body, and a second end facing away from the first one and hinged to a lower portion of said backrest.

25. The device according to claim 23, wherein said articulation means and said lever are configured so as to convert a rotational and traveling movement of reclining of said backrest into a rotational and traveling upward movement of said seat support.

26. The device according to claim 23, wherein said lever is placed between said first and said second swinging arm and wherein said second swinging arm has its first end hinged to a rear portion of the main body close to said backrest, and its second end hinged to an end of the lower portion of the backrest.

* * * * *